United States Patent [19]

Johnston

[11] 4,155,303

[45] May 22, 1979

[54] DETACHABLE INK FOUNTAIN

[76] Inventor: Willis K. Johnston, 2122 Tudor Castleway, Decatur, Ga. 30035

[21] Appl. No.: 878,671

[22] Filed: Feb. 17, 1978

[51] Int. Cl.[2] ..... B41F 31/04; B41F 1/40

[52] U.S. Cl. ..... 101/363; 101/365

[58] Field of Search ..... 101/365, 350, 363, 364, 101/207, 208, 210; 16/169, 172, 168, 176, 178, 137; 403/151, 154; 118/261

[56] References Cited

U.S. PATENT DOCUMENTS

| | | | |
|---|---|---|---|
| 2,451,634 | 10/1948 | Ranger | 101/364 |
| 2,926,382 | 3/1960 | Knese et al. | 16/176 |
| 3,257,943 | 6/1966 | Shank | 101/364 |

FOREIGN PATENT DOCUMENTS

| | | | |
|---|---|---|---|
| 31330 | 11/1933 | Netherlands | 16/176 |

*Primary Examiner*—J. Reed Fisher
*Attorney, Agent, or Firm*—Harold L. Marquis

[57] ABSTRACT

A detachable ink fountain which is attached to a printing press by hinges with circular apertures through which a pivot shaft extends with circumferential grooves adjacent to each hinge which has a slot from the aperture to the outside surface of the hinge with at least a portion of slot having a dimension greater than the diameter of the pivot shaft but less than the diameter of the groove.

6 Claims, 7 Drawing Figures

DETACHABLE INK FOUNTAIN

BACKGROUND OF THE INVENTION

The ink fountain in a printing press has a chamber, defined by the fountain roll and the fountain blade, in which the ink used in the printing operation is contained. The ink is fed from the fountain onto the surface of the fountain roll by rotating the roll. Another roll is used to take up the ink from the surface of the fountain roll and transfer it to a printing plate. Various adjustments are provided for adjusting the lip of the fountain blade against the surface of the fountain roll. When it is necessary to clean the fountain as when changing color or type of ink, the blade and fountain roll must be thoroughly scraped and cleaned. The ink fountains on many present presses can be swung down for cleaning and back into position without disturbing the adjustment of the fountain blade to the fountain roll.

As it is often difficult to clean the ink fountain while attached to the press, it would be desirable if the ink fountain could be detached from the press. Because the proper adjustment of the fountain blade to the fountain roll is time consuming, much of the advantage of having a detachable fountain would be lost if the blade had to be readjusted upon its reattachment to the press.

The principal object of this invention is to provide an ink fountain construction wherein the ink fountain can be removed from the press for cleaning and reattached in the same alignment between the fountain roll and blade.

It is a further object to provide a swing-down feature in the detachable ink fountain.

DETAILED DESCRIPTION OF THE DRAWINGS

Figure 1:
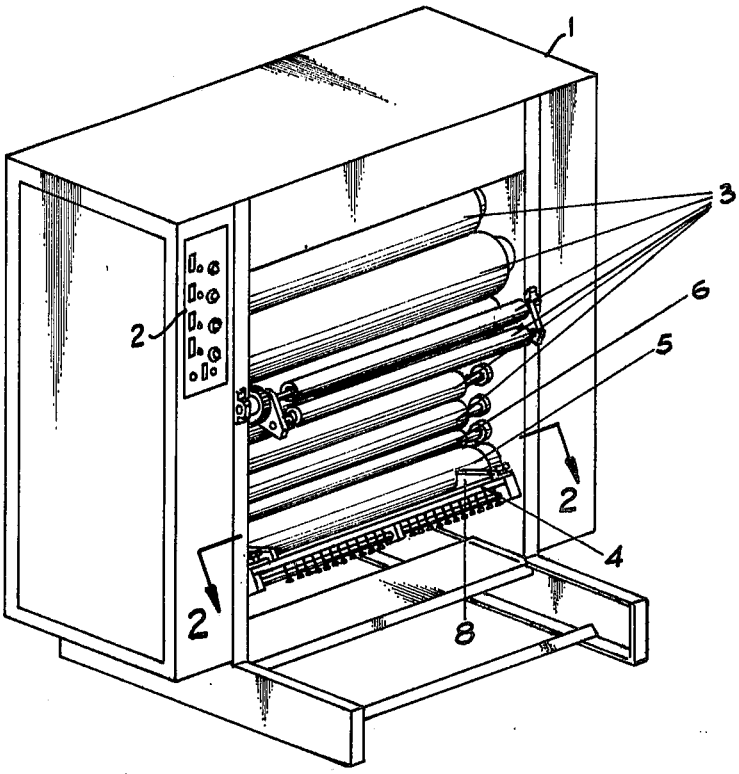
FIG. 1 is a front perspective view of a web offset press.
Figure 2:
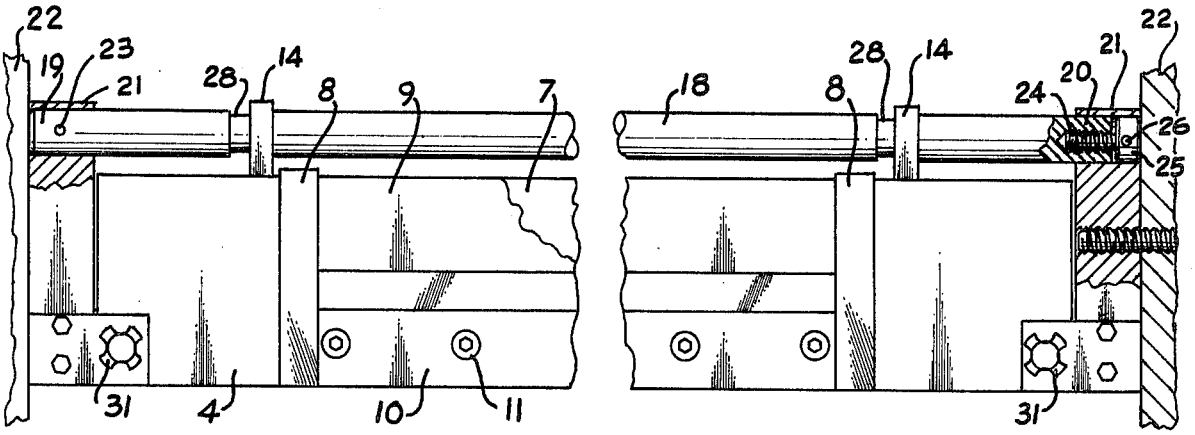
FIG. 2 is an enlarged top sectional view of the ink fountain attached to the press taken along lines 2—2 of FIG. 1.
Figure 3:
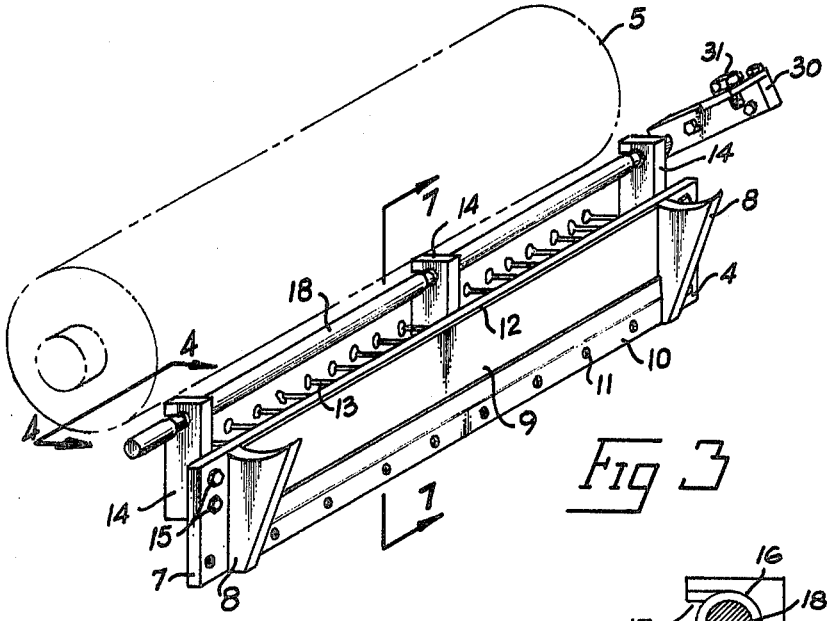
FIG. 3 is a front perspective view of the ink fountain in its swung-down position.
Figure 7:
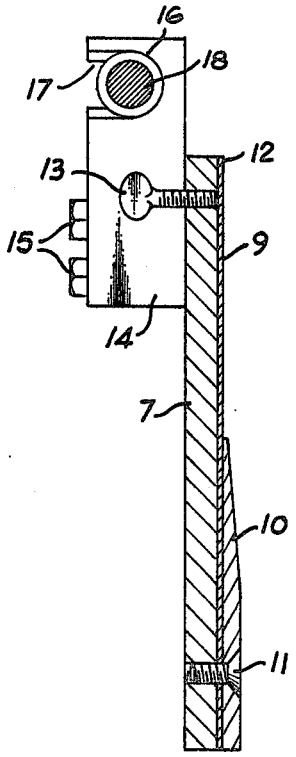
FIG. 7 is a vertical section of the ink fountain taken along lines 7—7 of FIG. 3.
Figure 6:
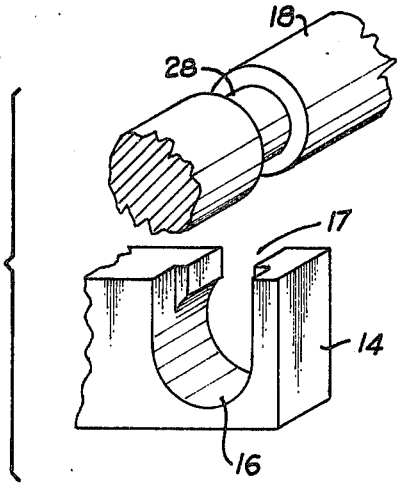
FIG. 6 is a side perspective view of the detachable hinge and shaft with the hinge in the detached position.

A conventional web offset press with a control panel 2 and a number of rollers 3 is shown in FIG. 1. It has a detachable ink fountain 4 for containing ink. Ink is fed from the fountain onto the surface of the fountain roll 5 by rotating the roll and then onto the pick up roller 6 for transfer to the printing plate. As shown in FIG. 3, the ink fountain 4 is of conventional construction with a fountain back 7 and sides 8 for confining ink in the fountain. As shown in FIG. 7, the fountain has a fountain blade 9 held in position by plate 10 at the front and is secured to the fountain back 7 by screws 11 extending through the plate 10 and blade 9 and entering threaded sockets in the fountain back 7. The lip 12 of the fountain blade 9 can be adjusted into proper contact with the fountain roll 5 by adjusting thumb screws 13 which extend through threaded holes in the fountain back 7. These screws can move the lip 12 of the blade away from the fountain back.

Three detachable hinges 14 are affixed to the fountain back 7 at each end and in the middle by bolts 15 extending through the fountain back 7 and hinge 14. More than three or as few as two such hinges can be used as deemed necessary. Each hinge 14 extends inwardly towards the fountain roll 5 when in the swung-down position. The hinge 14 has a circular aperture 16 with an axis parallel to the longitudinal plane of the ink fountain 4. Each aperture has a slot 17 which extends to the outside surface of the hinge opposite the side adjacent to the fountain back 7.

The ink fountain 4 is attached to the press by a circular pivot shaft 18 which extends through each aperture 16. The ends of the fountain shaft 19 and 20 are held in place by brackets 21 affixed to the press frame 22. The pivot shaft 18 is prevented from rotating by a pin 23 which runs through the end of the shaft and into bracket 21. In order to insure that the pivot shaft 18 is positioned tightly against each side of the press frame 22, the other end of the pivot shaft can be provided with a threaded socket 24 into which a T-shaped lug 25 is engaged. The pivot shaft can be inserted into the frame and tightened by inserting a pin 26 through the lug and into a bracket 21 affixed to the press frame 22. The pivot shaft can then be tightened by rotating and secured by inserting pin 23.

Figure 4:
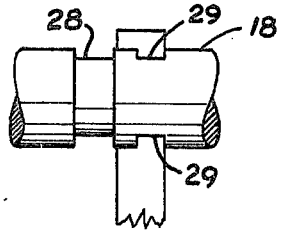
FIG. 4 is a back view of the detachable hinge in its attached swung-down position.
Figure 5:
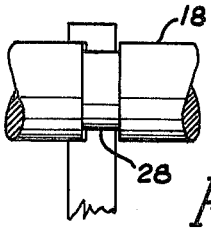
FIG. 5 is a back view of the detachable hinge in its swung-down position for detaching.

The pivot shaft 18 has circumferential grooves 28 located immediately adjacent to each hinge 14 when the ink fountain 4 is attached in its ink dispensing position as shown in FIG. 1. All of the grooves 28 are either to the immediate left or right of its corresponding hinge. The diameter of the slot 17 of the aperture 16 is smaller than the diameter of the pivot shaft 18 as shown in FIG. 7 in order to hold the ink fountain 4 in position. The diameter of this slot 17 is slightly larger than the diameter of the corresponding groove 28 of the shaft 18 so that the hinge can be detached from the shaft 18. In the preferred embodiment as shown in FIG. 4 only a shoulder 29 of the slot 17 is smaller in diameter than the pivot shaft 18, which makes it easier to remove and reinstall the ink fountain 4 than when the entire slot 17 is smaller. The width of the groove 28 is slightly greater than the width of the shoulder 29. In order to install the ink fountain, the shoulder 29 of each slot 17 is aligned with the corresponding groove and slid into position so that the groove is encompassed within the aperture 16. The ink fountain 4 can then be slid to the right on the shaft 18 so that the shoulder 29 of each aperture 16 overlies a portion of the pivot shaft 18 adjacent the groove which secures the ink fountain 4 to the shaft. The shoulder 29 serves to guide the aperture 16 into proper position on the pivot shaft 18. When the groove 28 is of the same width as the slot 17, the aperture 16 tends to rest in the groove 28 making it difficult to move the ink fountain 6 to one side so the aperture encompasses the pivot shaft 18 during attachment. The ink fountain 4 can then be rotated upward on the pivot shaft 18 and attached on each end to a bracket 30 secured to the frame of the press by a thumbscrew 31 extending through bracket 30 and entering threaded sockets in the fountain back 7. The fountain 4 can be removed by reversing the procedure. The fountain can be swung down for cleaning and back into position without removing if it is not slid to the left.

The ink fountain is not only easily detachable, but the fountain blade need not be readjusted when the fountain is reattached. This detachable ink fountain may be used on all types of printing presses but is especially advantageous with web offset presses.

What I claim is:

1. A detachable ink fountain for a printing press, said press having spaced frame members with a fountain roll therebetween, a circular pivot shaft extending between said frame members, means for mounting said circular shaft for non-axial movement between said frame members, said ink fountain comprising a knife blade, a knife-supporting assembly and sides which form an ink reservoir with the fountain roll of the press when the ink fountain is in the ink feeding position, means for releasing and holding the ink fountain on said press in the ink feeding position, said assembly having a plurality of hinges attached thereto, each hinge having a circular aperture through which extends said circular pivot shaft by which the ink fountain is attached to the press, each hinge having a slot extending from the circumference of the aperture to an outside surface of the hinge, with at least a portion of said slot having a smaller dimension than the diameter of that portion of the circular pivot shaft which is encircled by the aperture when the ink fountain is in the ink feeding position in order to hold the ink fountain on the pivot shaft, the pivot shaft having circumferential grooves located adjacent to each aperture when the ink founatin is in the ink feeding position, each groove having a width sufficient to receive that portion of the slot to the aperture having the smaller dimension, with the diameter of the circular shaft at each groove being smaller than the smaller dimension of the respective slot to the aperture so that the ink fountain can be detached from the pivot shaft by sliding the ink fountain longitudinally along the pivot shaft until the portion of each hinge slot with the smaller dimension is aligned with the adjacent circumferential groove on the pivot shaft.

2. The detachable ink fountain of claim 1 in which the assembly has three hinges.

3. The detachable ink fountain of claim 1 in which the slot to each aperture extends to the outside surface of the hinge which is opposite the side of the hinge adjacent the assembly.

4. The detachable ink fountain of claim 1 in which the axis of the pivot shaft and the axis of each aperture is parallel to the longitudinal plane of the assembly.

5. The detachable ink fountain of claim 4 in which the slot to each aperture extends to the outside surface of the hinge which is opposite the side of the hinge adjacent the assembly.

6. The detachable ink fountain of claim 5 in which the means for releasing and holding the ink fountain in the ink feeding position comprise a bracket attached to the press adjacent each end of the ink fountain when in the ink feeding position and means for attaching the ink fountain to such bracket.

* * * * *